US005392867A

United States Patent [19]

du Chaffaut et al.

[11] Patent Number: 5,392,867

[45] Date of Patent: Feb. 28, 1995

[54] DEVICE FOR REMOTELY OPERATING AND ASSEMBLY COMPRISING A BEAN/NEEDLE SYSTEM, AND USE THEREOF IN A DRILL STRING

[75] Inventors: Benoit A. du Chaffaut, Voisins le Bretonneux; Jean Boulet, Paris, both of France

[73] Assignee: Institut Francias du Petrole, Malmaison Cedex, France

[21] Appl. No.: 920,486

[22] PCT Filed: Dec. 6, 1991

[86] PCT No.: PCT/FR91/00976

§ 371 Date: Oct. 20, 1992

§ 102(e) Date: Oct. 20, 1992

[87] PCT Pub. No.: WO92/11461

PCT Pub. Date: Jul. 9, 1992

[30] Foreign Application Priority Data

Dec. 21, 1990 [FR] France ..... 90 16257

[51] Int. Cl.[6] ..... E21B 21/10

[52] U.S. Cl. ..... 175/38; 175/73

[58] Field of Search ..... 175/38, 61, 73, 76, 175/92, 107, 232, 256, 320

[56] References Cited

U.S. PATENT DOCUMENTS

| | | | |
|---|---|---|---|
| 4,615,399 | 10/1986 | Schoeffler | 175/38 |
| 4,811,798 | 3/1989 | Falgout, Sr. et al. . | |
| 4,895,214 | 1/1990 | Schoeffler | 175/73 X |
| 5,065,825 | 11/1991 | Bardin et al. | 175/38 |

FOREIGN PATENT DOCUMENTS

| | | |
|---|---|---|
| 0409446 | 7/1990 | European Pat. Off. . |
| 2432079 | 7/1978 | France . |
| 2575793 | 7/1986 | France . |
| 2641315 | 7/1990 | France . |
| 2641320 | 7/1990 | France . |

*Primary Examiner*—Michael Powell Buiz
*Attorney, Agent, or Firm*—Antonelli, Terry, Stout & Kraus

[57] ABSTRACT

A device for remotely operating equipment through a variation in the flow of a fluid includes a coupling unit connecting the device and the equipment to be operated, an assembly of two elements cooperating with one another to control an opening value of a channel through which the fluid flows and a control assembly for adjusting the opening value in order to have it take on one or the other of two particular values.

11 Claims, 8 Drawing Sheets

DEVICE FOR REMOTELY OPERATING AND ASSEMBLY COMPRISING A BEAN/NEEDLE SYSTEM, AND USE THEREOF IN A DRILL STRING

BACKGROUND OF THE INVENTION

The present invention relates to a device for remote control or operation of an equipment used in relation to pipes in which a fluid circulates. The operation is performed through the circulation of a flow of fluid which is lower than the working flow rates.

In the field of oil drilling, it is often necessary to remotely operate tools located in the wellbore.

Operating such tools requires high energies.

According to the prior art, an annular piston having two faces and a throttling device comprising a needle-flow bean with a variable flow section are used. One face of this piston is subjected to the pressure forces prevailing on one side of the throttling device, the other face being subjected to the pressure forces on the other side of the throttling device.

The flow bean is generally borne by the piston and the needle is fastened in relation to a duct containing the assembly and within which the piston can move to perform the desired operating function. The piston comprises return means which maintain it in a rest position corresponding to a relatively large flow section of the throttling device, leading to a low pressure drop for the working flow rates.

To operate the equipment, the rate of flow is increased, which raises the pressure drop on either side of the throttling device, and the piston therefore tends to move by acting against the return means. During this motion, the flow bean enters more and more the throttling device, hence a higher increase in the pressure drop providing the power necessary for operating the equipment.

The prior art can be illustrated by French patent 2,575,793.

Such a device lacks precision as far as the threshold flow rate bringing about the activating of the operating is concerned. In fact, the assembly consisting of the piston and the return spring, which must react to or transmit considerable powers, cannot be precisely sensitive to a given threshold flow rate, owing to the frictional stresses for example.

Moreover, the device works through an increase in the flow rate in relation to the working flow rates. But the drilling conditions may forbid such an increase in the flow rate. In fact, the consequent increase in the pressure drops downstream from the device can lead to fracturations in the ground or destabilize the walls of the well, which may challenge the safety of the operation. Besides, a power increase in relation to the power used for drilling is often impossible because the pumping equipment is frequently already run at full power for the drilling operation itself.

French patent 2,641,320 solves the problem of the precision of the threshold flow rate by utilizing a flow bean or a needle borne by the piston, but moving in relation to the piston.

This flow bean or this needle, of a relatively small size in relation to the piston, and equipped with appropriate return means, is precisely sensitive to a flow rate threshold, but the operating still has a major drawback in that it is released by an increase in the flow rate in relation to the working flow rates.

The present invention allows to solve the two problems by using an appropriate needle-flow bean or equivalent system which notably allows to release the operating by using a flow rate threshold less than or equal to the working flow rates, while providing a considerable activation force as necessary for the operating.

According to the prior art, the process which consists in feeding a ball or another sealing device into the fluid circulation pipeline is well-known. The ball falls or is pumped onto a piston comprising a seat. The pipeline being sealed by the ball cooperating with the seat, the pumping can then develop an operating pressure on the piston without requiring a high flow rate. This method still has many drawbacks. In fact, the operation time may be relatively long according to the drilling depth, and the total sealing of the circulation channel requires a complex and delicate system for ejecting the ball after the operating. The failures of such a system can be disastrous for the following operations. The need to have a clear pipeline to let the ball through limits the cases of use, for example it forbids to set a possible downhole motor between the operating device and the surface, and besides no measuring devices are allowed between the device and the surface. These drawbacks are very restrictive, considering the sphere of application which notably concerns directional drilling where such equipments are commonly used.

SUMMARY OF THE INVENTION

The present invention allows to control the operating with a low flow rate without requiring the feeding of a ball, and it leaves the circulation channel clear of any major obstacle which might suppress the possibility of circulating a fluid in the wellbore.

The present invention thus relates to a device for remote operating an equipment through a variation in the flow of a fluid, possibly incompressible, comprising coupling means between said device and said equipment, an assembly comprising at least two elements cooperating with one another to control the opening value of the channel which said fluid flows through.

This device is characterized in that it comprises a control assembly which adjusts said opening value in order to have it take on one or the other of two particular values, in that the remote operating of the equipment is performed for predetermined flow features when said control assembly sets to one of the two particular opening values of said elements, and in that, for the same flow conditions, the operating is not obtained when said control assembly sets to the other opening value of said elements.

The assembly comprising two elements can be an assembly comprising a flow bean and a needle. Said coupling means can comprise one of these elements and the other element can be mounted sliding in the pipe.

The device is characterized in that said control assembly can comprise means for blocking the sliding of said element mounted sliding in the pipe, which limit said sliding following two stroke lengths which correspond to said two predetermined opening values.

The element mounted sliding in the pipe can comprise a return means, said return means sets the opening value of the channel which the fluid flows through to a value notably smaller than said predetermined opening values. The hydrodynamic force generated by the flow of the fluid at the level of said element mounted sliding in the pipe notably opposes the force developped by said return means and said hydrodynamic force makes said element mounted sliding slide by one or the other sliding stroke value.

The device is also characterized in that said element mounted on said coupling means can be mounted sliding in relation to said coupling means and in that this element comprises a return means whose force opposes the hydrodynamic force generated by the flow of the fluid at the level of said element borne by said coupling means.

Said element borne by the coupling means can be the flow bean and the other element is then the needle. The coupling means can be an operating shaft.

The means for controlling the device can comprise a system of cooperating fingers with a groove of variable depth and whose shape adjusts the sliding stroke of said element mounted sliding in the pipe following said two particular values.

The needle can comprise different straight-line sections over the length thereof. The cooperating of these straight-line sections with the flow bean can bring about a notable variation in the flow state of the fluid and this variation can be remote measured.

The device can be applied to the operating of equipments integrated in a drill string.

An application of said device can be characterized in that the device, by operating one or several variable geometry stabilizers or a variable angle bent sub, can allow to control the direction of the trajectory of a wellbore.

BRIEF DESCRIPTION OF THE DRAWINGS

The present invention and the advantages thereof will be clear from the following description given by way of non limitative examples and with reference to the accompanying drawings in which:

FIGS. 5 and 5A relate to the configuration of FIG. 3.

FIGS. 6 and 6A relate to the configuration of FIG. 4.

FIGS. 7 and 7A relate to the case of the displacement of the finger in the groove without performing any operating or without reaching the drilling flow rate.

DESCRIPTION OF THE PREFERRED EMBODIMENTS

The leading idea of the invention is based on a device for partly sealing the passageway of the fluid flow rate circulating in the pipe in which said device is installed. This device can be adjusted according to at least two sealing levels: one corresponds to the sealing value allowing to operate said equipment, the other corresponds to a minimum sealing value, that is to say the maximum opening of said device which corresponds to the circulating conditions of the fluid allowing to carry out various conventional operations, notably drilling. When the device is set to the first level, the operating is performed according to the prior art thanks to the pressure drops generated by said obturation of the circulation channel. This pressure difference is sufficient for acting on operating means such as a piston, to allow the operating of an equipment. These operating means are not operated when the sealing value corresponds to the second adjusting level. One of the main advantages of this device is that the level of obturation of the channel can be such that the flow rate necessary for generating the operating energy is notably lower than the working flow rates. The adjusting assembly can be remote controlled with all the well-known means, notably by pressure waves in the pipe, by electromagnetic waves, by axial forces on the pipe, by rotation of the pipe or by any other means for remote communicating with the device.

Figure 1:
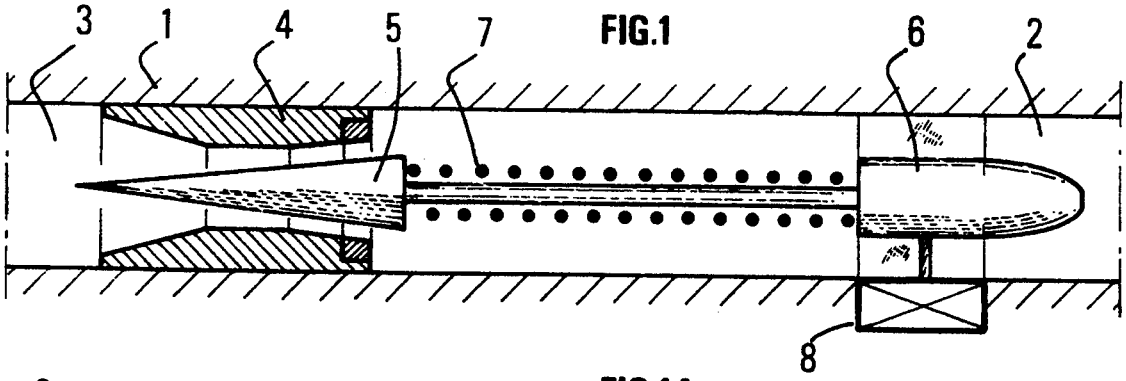
FIGS. 1, 1A and 1B show the fundamental principle of the leading idea of the invention according to a simplified schematization.

FIG. 1 diagrammatically shows a system for partly sealing pipe 1 separating the pipe in a downstream part 2 and an upstream part 3 in relation to the sealing system. The system itself comprises a flow bean 4 immovably attached to the pipe and a needle 5. The needle 5 is borne by an adjusting equipment 6 and can slide in relation to flow bean 4. The adjusting apparatus is controlled by an assembly 8. This figure shows a control principle utilizing the flow of the fluid through the sealing system. FIG. 1 more particularly shows the position known as rest position of the sealing system when no fluid is circulated. The action of a return means 7 maintains the needle 5 in the position of the deepest penetration thereof in the flow bean 4.

Figure 1A:
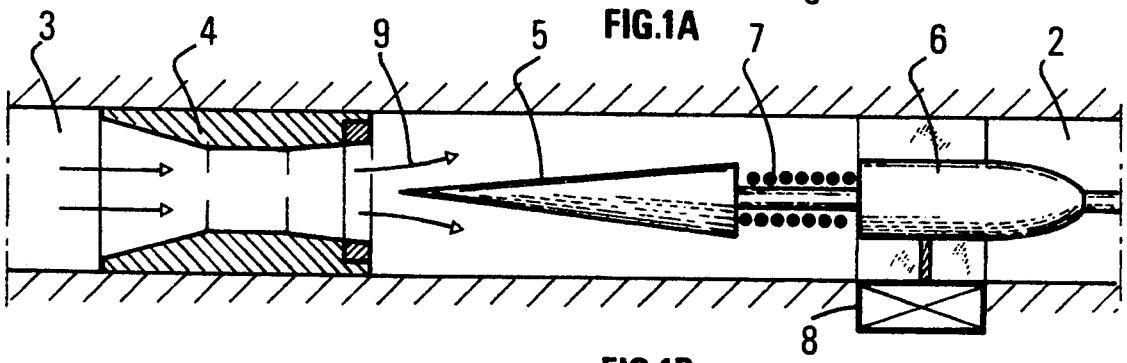

FIG. 1A shows the sealing system in the position of the highest fluid flow thereof. The command received by assembly 8 has adjusted the apparatus 6 in such a way that the sliding of needle 5, from the position shown in FIG. 1, has the longest stroke. The flow of the fluid at the level of needle 5 acts against the return means 7, which brings about the backward motion of needle 5. The flow of the fluid shown by arrows 9 only causes a minimum pressure drop between the zones 2 and 3 of the line.

Figure 1B:
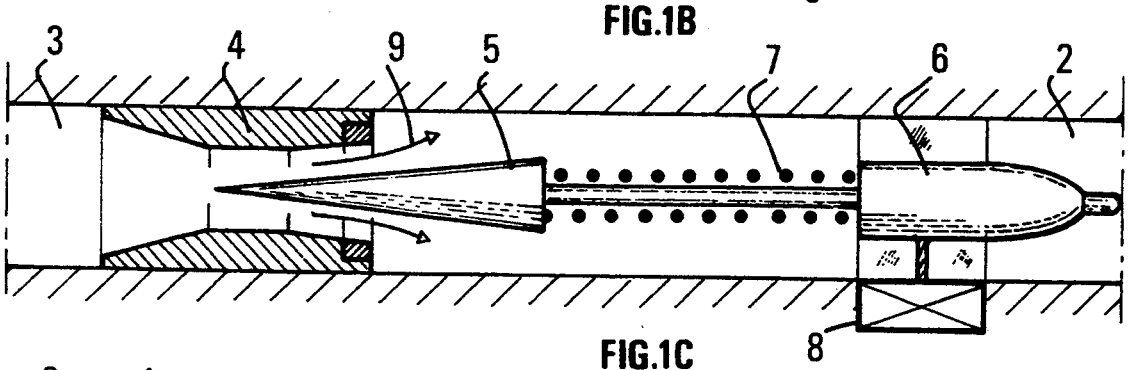

FIG. 1B shows the sealing system in the operating position thereof. The command received by assembly 8 has adjusted the apparatus 6 in order to limit the sliding stroke of needle 5 in order to decrease the flow of the fluid through the cooperating of the flow bean 4 with needle 5. For a predetermined rate of circulation which can be lower than the working flow rates, the pressure drop generated between 2 and 3 operates the equipment located upstream from said device.

Figure 1C:
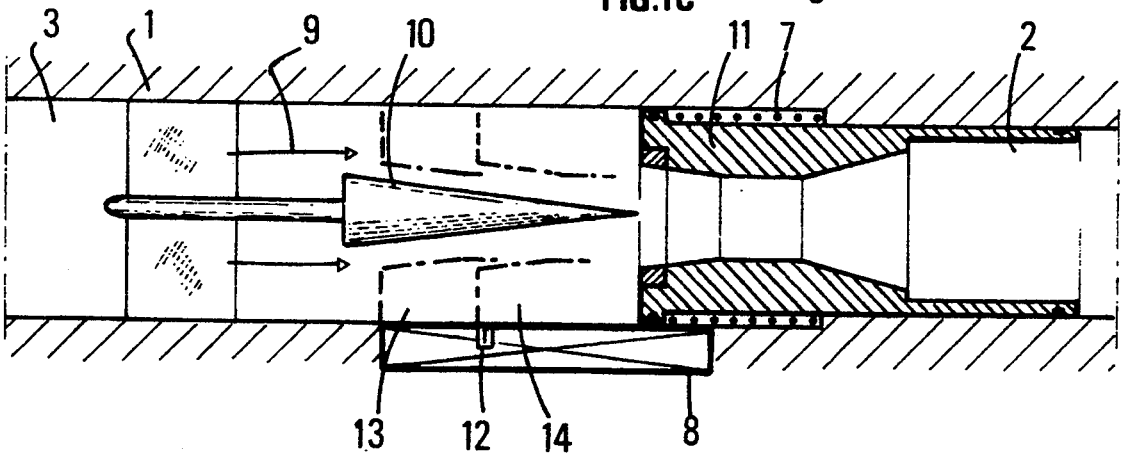
FIG. 1C shows the principle of the invention according to another procedure.

FIG. 1C shows the same principle of the sealing system but in the case when the needle 10 is fixed in the pipe and the flow bean 11 slides in relation to the needle. A return means 7 positions the flow bean in the shown location 13 in the absence of a flow rate. The two positions are obtained according to the adjusting of assembly 8 which acts upon a retaining element 12. The flow bean performs a maximum backward motion under the effect of the circulation when the retaining element 12 is retracted, the adjustment then corresponds to the drilling position. The sliding of the flow bean is limited in the position 14 when retaining element 12 sticks out, the adjustment corresponds to the operating position.

Using systems for sealing the circulation channel other than the shown needle-flow bean system, notably in the form of a check valve, can be done without departing from the scope of the invention. Besides, the invention may comprise no position known a rest position such as the one shown in FIG. 1; in fact, the adjusting system 6 can be able to pass indifferently from the drilling position of FIG. 1A to the operating position of FIG. 1B without having to go through a rest position.

In this case, when there is no circulation, the sealing system can notably remain in the previous position thereof.

The coupling means between said device and the equipment to be operated can be hydraulic if the means for operating the equipment react to a pressure. They can be notably mechanical and, in this case, a piston cooperates with the sealing assembly through coupling means so that a face is subjected to the differential pressure generated between the parts 2 and 3. This piston can be connected through an operating shaft to the equipment. The displacement of the piston under the effect of the differential pressure provides the operating energy necessary for supplying the determined operating motion.

Figure 2:
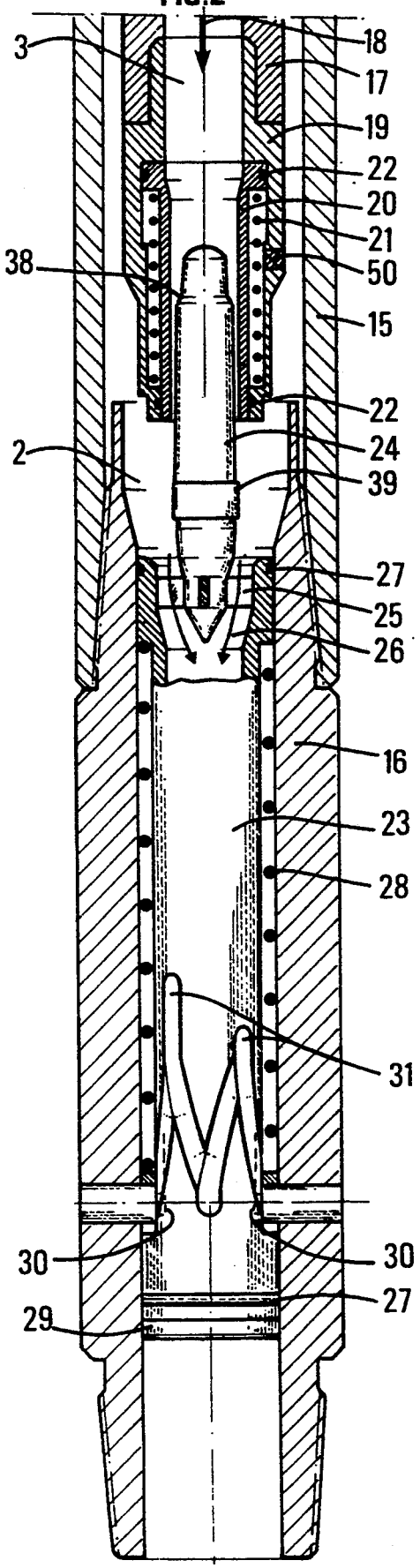
FIG. 2 shows the device, object of the invention, according to a preferred embodiment procedure which is not limitative. The representation is shown in case there is no fluid circulation in the pipe.
Figure 2B:
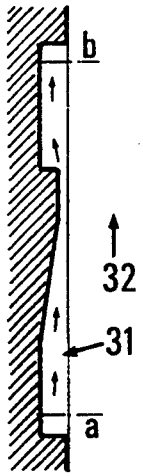
FIGS. 2B, 2C, 2D and 2E show the cross sections respectively following AB, BC, CD and DE of the groove of the control assembly.
Figure 2C:
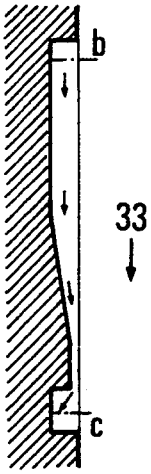
Figure 2D:
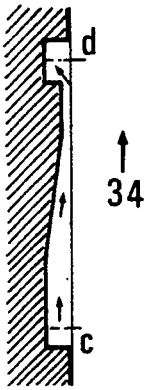
Figure 2E:
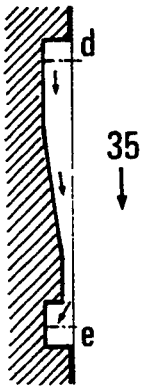

The advantage of the invention will be clear from reading the description of the device in the preferred but not at all limitative structural shape thereof shown in FIG. 2.

In FIG. 2, the body of the device consists in the assembling of two couplings 15 and 16 according to conventional methods. The upper coupling 15 contains the operating shaft 17 which is hollow. The direction of circulation of the fluid corresponds to the direction shown by arrow 18. The end of shaft 17 bears the assembly formed by a flow bean holder 19, a flow bean 20 and a return spring 21. Seal gaskets 22 complete the assembly. A bidirectional check valve 50 allows to balance the pressure between the chamber of the spring 21 and the outside. Flow bean 20 has therefore the shape of an annular piston with a differential section whose greater section is upstream from the flow.

The lower coupling 16 contains a piston 23 to which the needle 24 is immovably attached by means of a crossbar 25. This crossbar 25 is adapted for letting the fluid circulation pass as shown by arrows 26. The annular piston 23 comprises seals 27 substantially at each end, a return spring 28 and a section restriction 29.

At least one finger 30 cooperates with a groove 31 machined in the body of piston 23. This assembly constitutes a non limitative example of a system for adjusting the stroke of the piston 23 immovably attached to the needle 24.

Figure 2A:
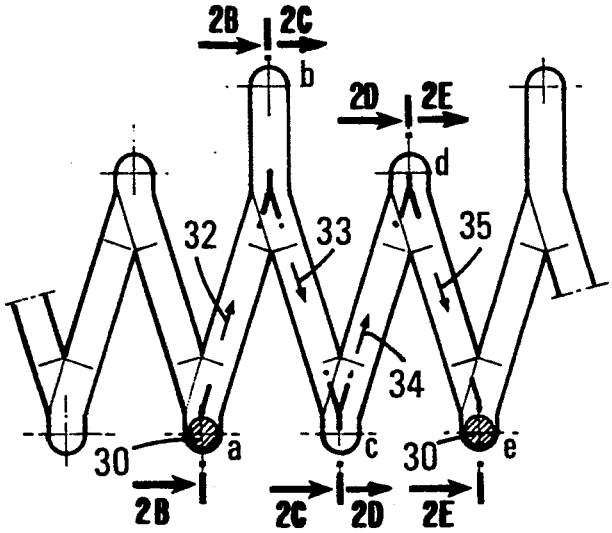
FIG. 2A is a partly developped view of the groove constituting one of the elements of the assembly controlling the stroke of the needle. The finger is shown in the position it occupies in the case of FIG. 2.

FIG. 2A is a developped view of said groove borne by piston 23. The groove is continuous over the circumference of the outer surface of piston 23. It is formed by a whole number of pitches. The M-shaped mark formed by the groove linking up the points a, b, c, d and e represents a pitch. The arrows 32, 33, 34 and 35 show the direction of displacement of finger 30 in said groove to go respectively from a to b, from b to c, from c to d and from d to e. A complete cycle is performed from a to e. While piston 23 moves by sliding, it is subjected to a rotation due to the inclination of each groove portion in relation to the axis of the piston. The direction of displacement of the fingers in the groove is irreversible thanks to the difference in the height of the groove bottom between two successive vertices. This appears in FIGS. 2B, 2C, 2D and 2E which respectively show the cutaways of the groove along AB, BC, CD and DE. FIG. 3B is a detailed view of the finger 30 retractable in the lodging thereof to be able to follow the height of the groove bottom.

The adjusting finger could be remote controlled notably through electromagnetic means to set the sliding of piston 23 to one of the two positions by cooperating with stopping devices borne by the piston without departing from the scope of this invention.

Figure 3:
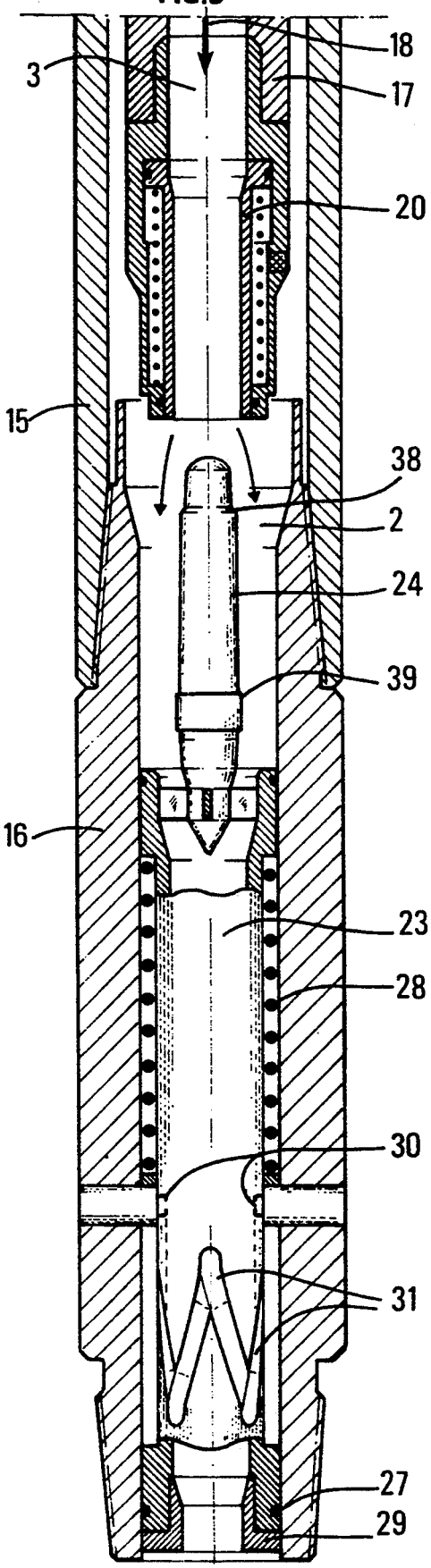
FIG. 3 shows the device according to the same preferred embodiment procedure as in FIG. 2, but the needle has the position it occupies while the fluid circulates at the working flow rates.
Figure 3B:
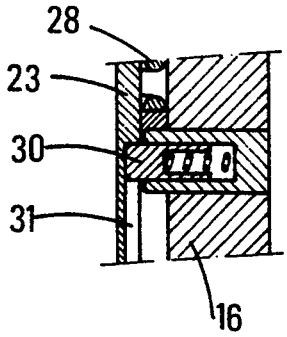
FIG. 3B is a detailed view of a finger 30 in the groove 31.

FIG. 3 shows the device in the drilling position where the fluid can be circulated at any flow rate, up to the maximum one, without having any operating, at least as long as the pressure drop between parts 2 and 3 remains lower than the operating differential pressure. The circulation rate shown by arrow 18 generates a hydrodynamic force on the needle 24 and piston 23 assembly. This force is adjusted according to the passageway restriction 29 located in the piston. When said force is higher than the force exerted by the return spring 28, the piston goes down until it is stopped by finger 30 in groove 31 when the finger lies at b.

Figure 3A:
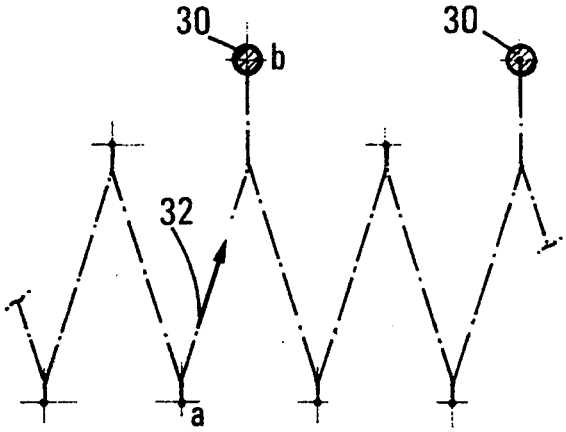
FIG. 3A shows the groove of the adjusting assembly with the relative position of the finger in the case of FIG. 3.

This position in shown in FIG. 3A.

The flow rate at which the needle disengages from the flow bean is called Qd. As long as the circulation rate remains notably higher than Qd, finger 30 is maintained at b. This will be the case in drilling with a flow rate Qf. On the contrary, if the circulation is stopped, the action of spring 28 becomes preponderant again, the needle 24 borne by piston 23 goes up into the flow bean, finger 30 follows arrow 33 and lies at c. The position of the device is identical to FIG. 2, except for the location of finger 30 in groove 31.

After the stage above, when the circulation rate is again increased up to values higher than Qd, finger 30 follows the arrow 34 when the needle 24 slides downwards.

Figure 4:
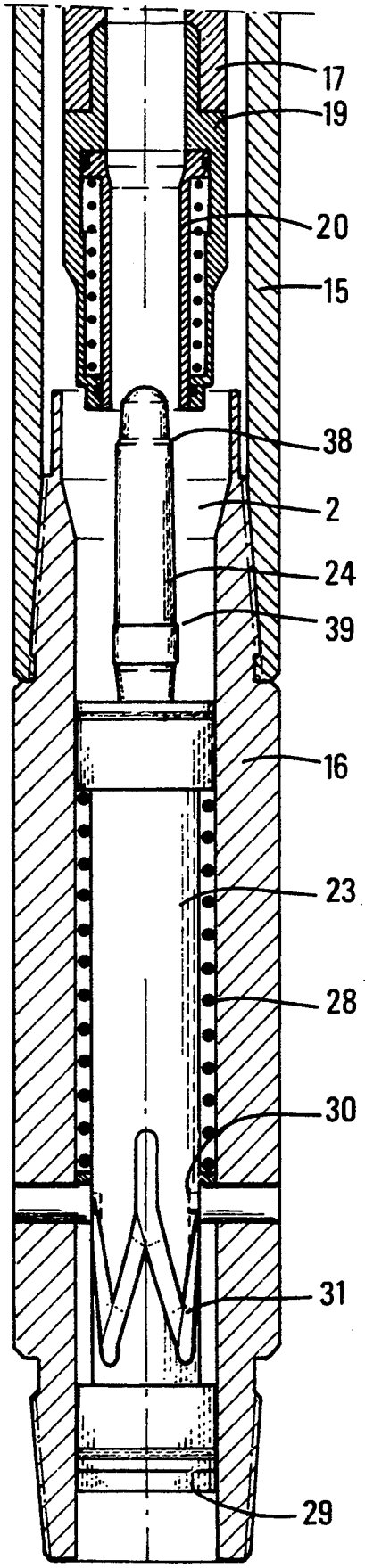
FIG. 4 shows the device according to the same preferred embodiment procedure as the one of FIGS. 2 and 3, but the needle is in the position allowing to operate the equipment.
Figure 4B:
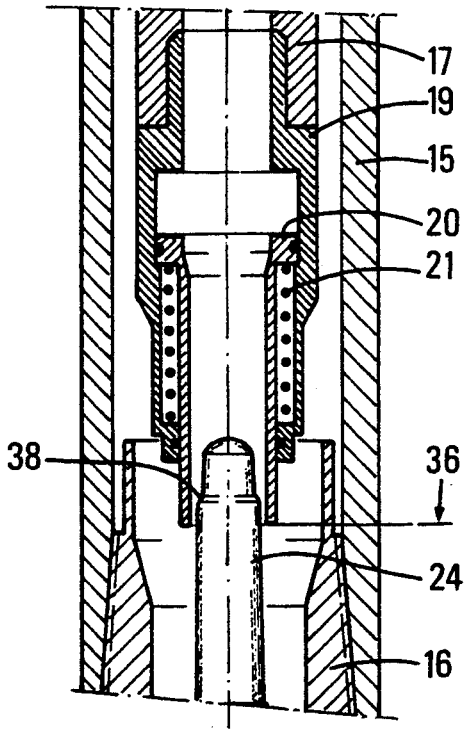
FIG. 4B shows the device at the beginning of the operating.
Figure 4C:
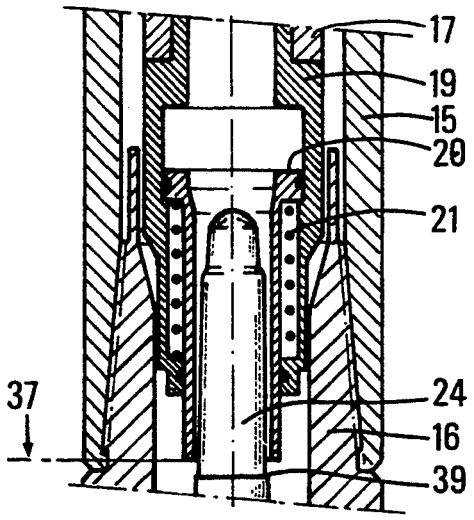
FIG. 4C shows the device at the end of the operating.
Figure 4A:
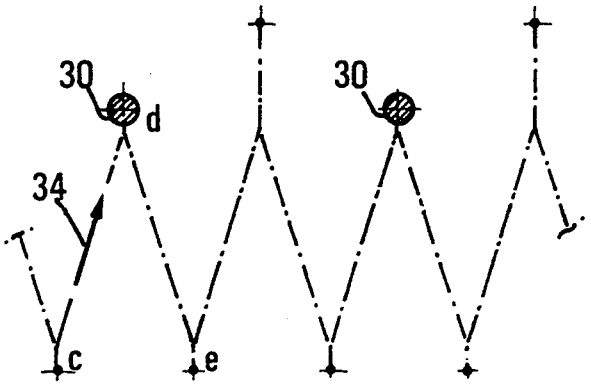
FIG. 4A shows the groove of the adjusting assembly with the relative position of the finger in the case of FIG. 4.

FIG. 4 shows the device in this position where finger 30 lies at d of FIG. 4A. The sliding of the needle-flow bean assembly is shorter because of the position of point d in the groove.

In this position, when the flow rate is increased up to a value higher than Qd, the operating is performed as follows:

the flow rate is increased up to a value Qa known as operating value, higher than Qd and lower than Qf, the pressure drop generated in the device is such that flow bean 20 slides towards the position 36 shown in FIG. 4B. The channel which the fluid flows through is even more reduced and, with a flow rate stabilized at Qa, the pressure drops increase while achieving the operating.

In this preferred embodiment example, the operating will be obtained through the translation of the shaft 17 coupling flow bean 20 with operating means. This assembly undergoes the differential pressure generated between parts 2 and 3 to slide towards the needle in the position 37 shown in FIG. 4C.

After the circulation rate has been cancelled, the device comes back to the position shown in FIG. 2.

Figure 5:
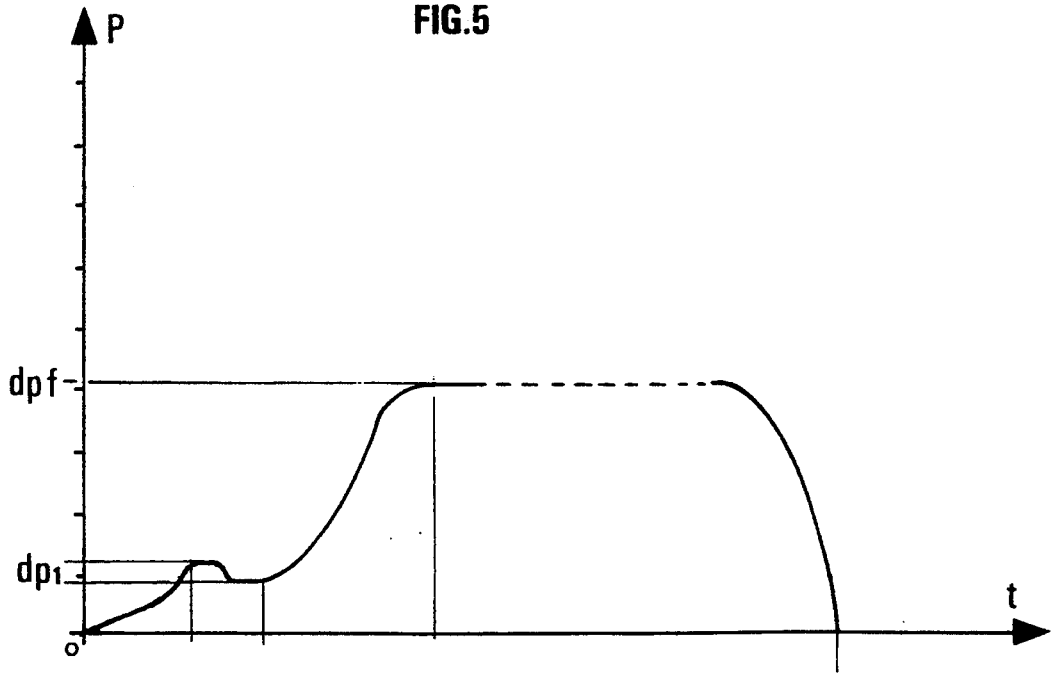
FIGS. 5, 6 and 7 show the development curves of the differential pressure dp measured between the upstream and the downstream of the assembly controlling the opening of the channel which the fluid flows through, and respectively according to the flow rate variations Q shown in FIGS. 5A, 6A and 7A.
Figure 5A:
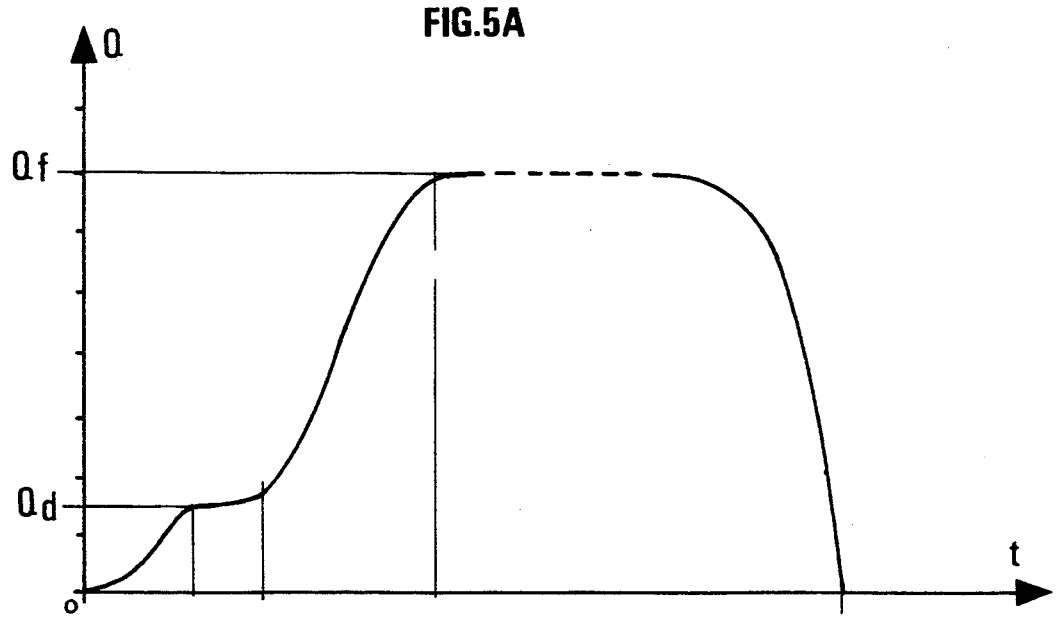

FIG. 5 shows the development of the differential pressure on either side of the device, according to time and in relation to FIG. 5A which shows the circulation flow rate at the same time. These two figures relate to the device when, at the time zero and with a zero flow rate, finger 30 lies in the position a. When the value of the flow rate has reached Qd, the needle is disengaged from the flow bean as in FIG. 2. The pressure peak dp1 corresponds to the disengaging of the chamfer 38 of the needle from the end of flow bean 20. In fact, the widening of the flow section corresponding to the final position of the relative displacement needle-flow bean substantially decreases the pressure for the circulation rate Qd.

The flow rate increase up to the drilling flow rate Qf causes the increase in the pressure up to dpf. This configuration will be maintained as long as the flow rate Qf remains higher than Qd. The differential pressure dpf is lower than the differential pressure which activates the operating. The device can be equipped with a remote-controlled system for locking said device in position without departing from the scope of the invention. In this case, the flow rate variation can be independant of Qd.

Cancelling the flow rate and a possible unlocking displaces finger 30 towards c.

Figure 6:
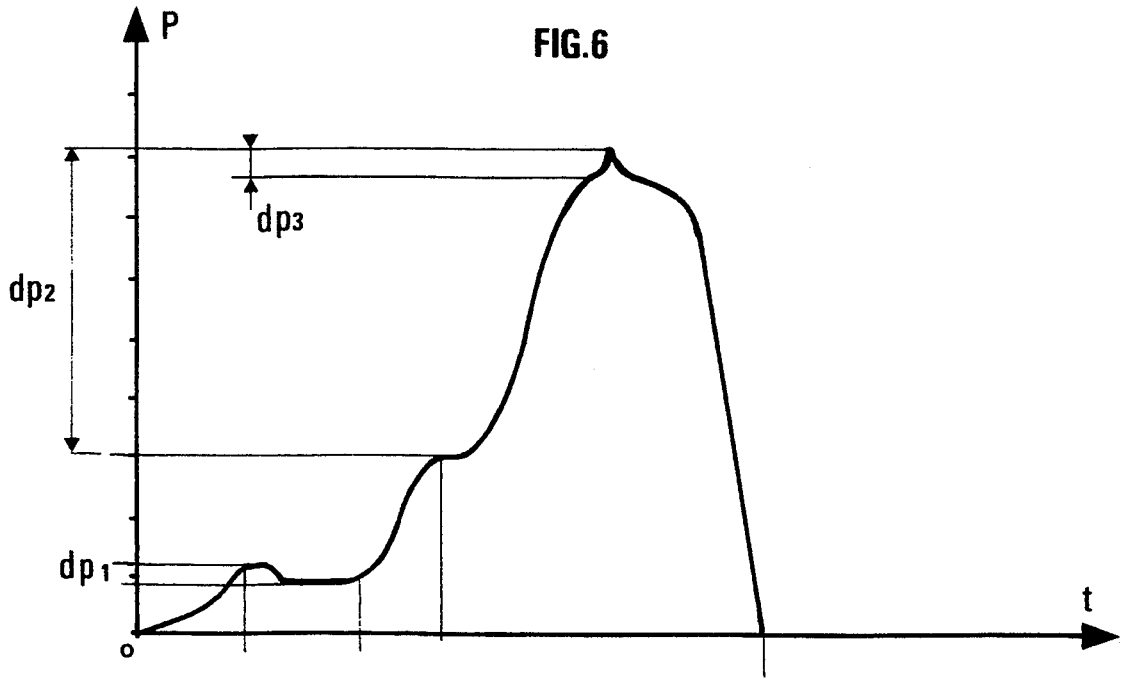
Figure 6A:
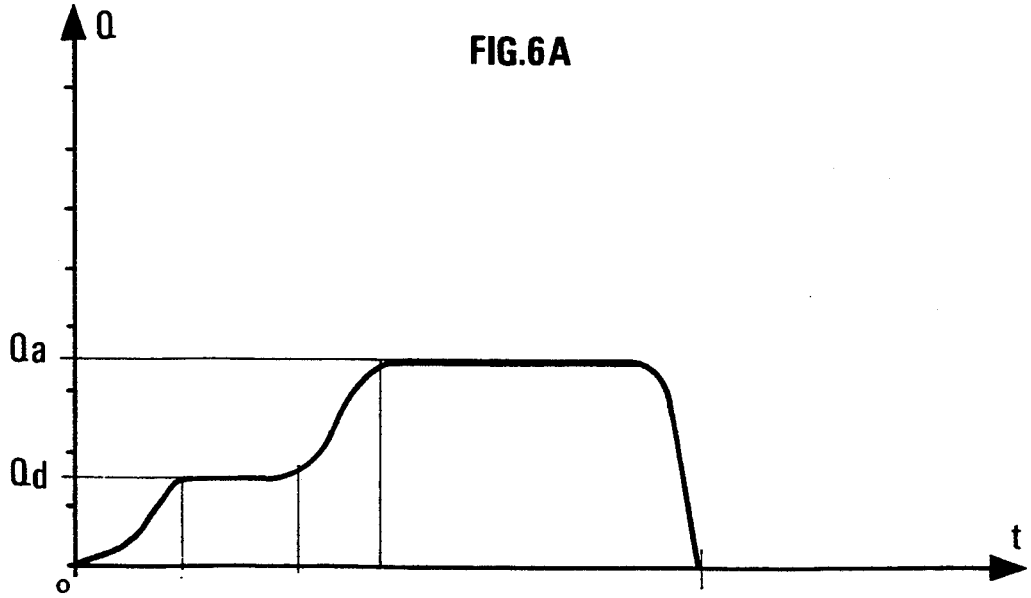

FIG. 6 shows the development of the differential pressure on either side of the device, according to time and in relation to FIG. 6A which shows the circulation flow rate at the same time. These two figures relate to the device when, at the time zero and with a zero flow rate, finger 30 lies in the position c. The flow rate is increased up to Qd so that the needle is disengaged and in order to visualize the pressure loss dp1. The flow rate is thereafter increased up to Qa, which is lower than Qf. The generated pressure drop makes the flow bean 20 slide. For the same flow rate Qa, the pressure increases by dp2, which corresponds to the operating of the device through the sliding of the operating shaft-flow bean assembly. The final pressure peak dp3 corresponds to the flow bean lying close to the chamfer 39 of the needle. The device can be equipped with a remote-controlled system for locking said device in position without departing from the scope of the invention. In this case, several successive operatings can be achieved.

Cancelling the flow rate and a possible unlocking displaces finger 30 to e, which amounts to the position a of a new cycle.

Figure 7:
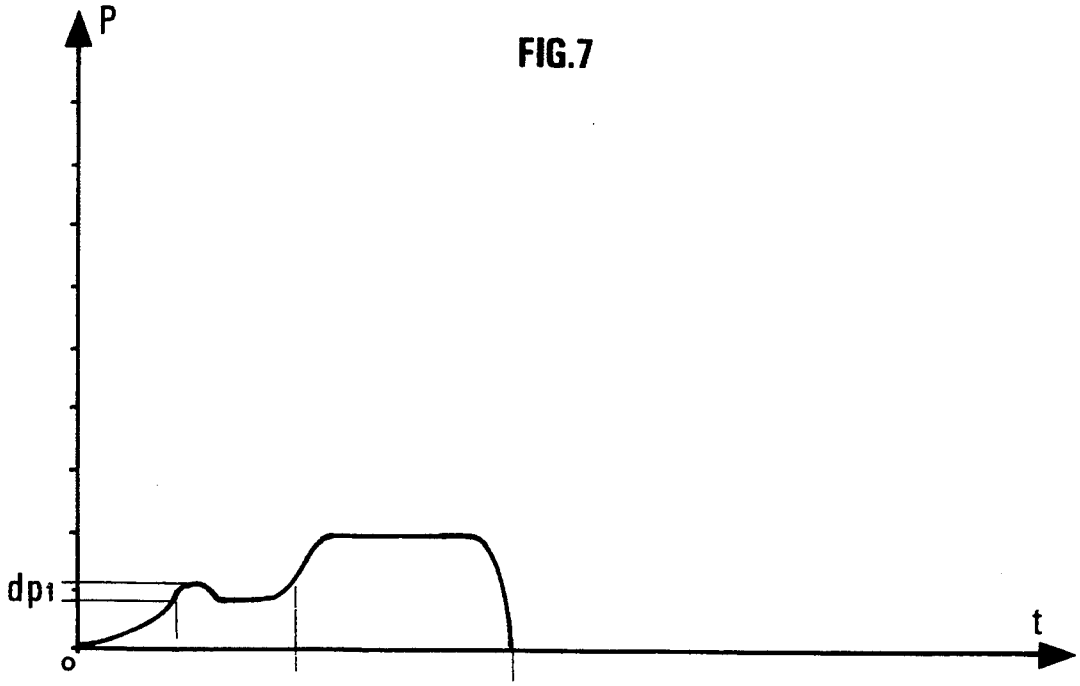
Figure 7A:
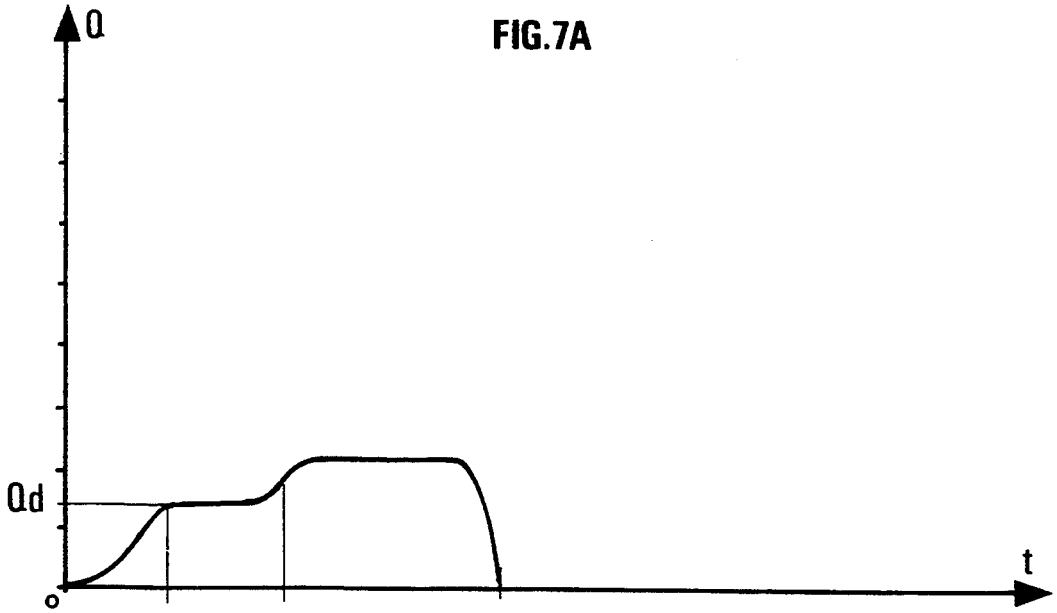

Finger 30 can be displaced in groove 31 without reaching the working flow rates or without achieving an operating. This working mode is shown in FIGS. 7 and 7A. The pressure increase following the value Qd of disengagement of the needle only has to be smaller than the value of the activation flow rate Qa. Two pressure rises according to the diagram of FIG. 7A, achieved successively, make follow a complete cycle ABCDE. This procedure allows all the operational cases, notably to activate several times in succession, to drill, then to stop drilling and to begin drilling again.

The generating, in the different pressure ranges, of peaks dp1 and dp3 through the cooperating of the profile of needle 24 and of flow bean 20 allows to remote visualize the achieving of the corresponding event: dp1 corresponds to the disengaging of the needle, dp3 corresponds to the end of the operating.

The device can be preferentially applied to the remote operating of equipments intended to control the drilling direction. These equipments are notably string stabilizers or bent subs.

Figure 8:
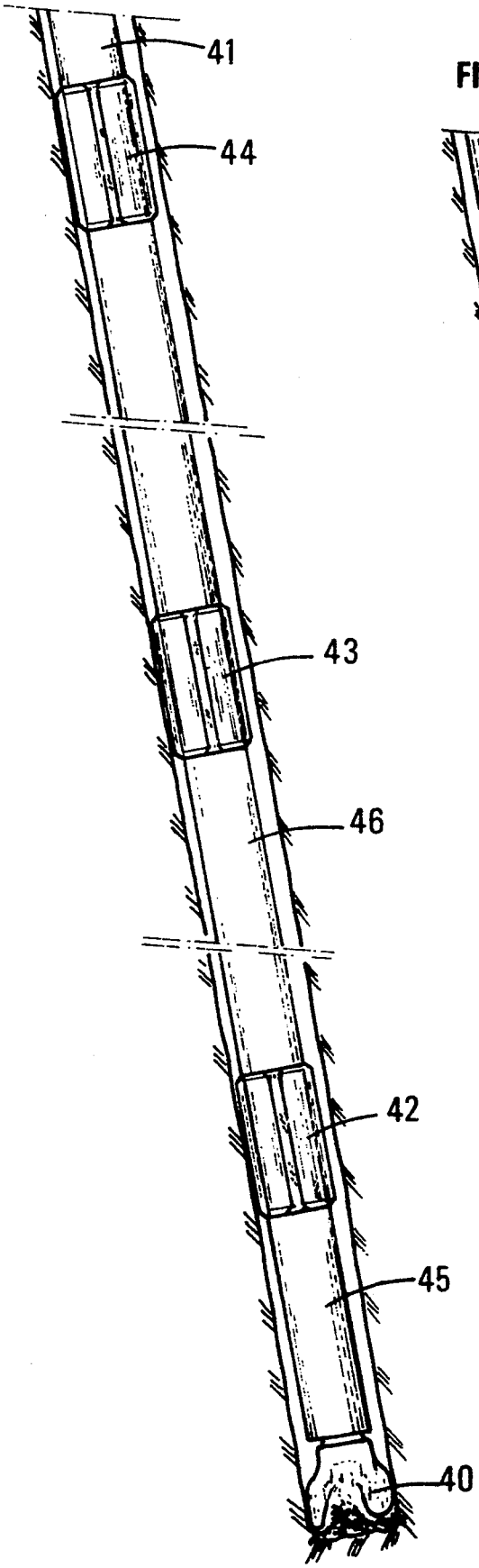
FIG. 8 gives an example of the application of the device to a rotary drill string.

FIG. 8 shows the case of a rotary drill string. The drill bit 40 is rotated by pipes 41 going back up to the surface and making up the drill string. Stabilizers 42, 43 and 44 are screwed to the lower part of said string. The lay-out can notably be the following: the operating device located just above bit 40, stabilizer 42 above the device, a drill collar 46, another stabilizer 43, another drill collar and then a stabilizer 44. When the three stabilizers have the same diameter as the drill bit, a rather stiff assembly tending to drill in a substantially rectilinear way is obtained. Stabilizers 42 and 43 can be of the variable geometry type, as disclosed in document FR 2,641,315, and operated by means coupled to said device of the present invention. The operating can notably totally retract the blades of said stabilizers 42 and 43. The drill string has therefore been converted without any dismantling operation, thanks to the operating device, into a pendulum assembly which will tend to drill while approaching the vertical.

Figure 9:
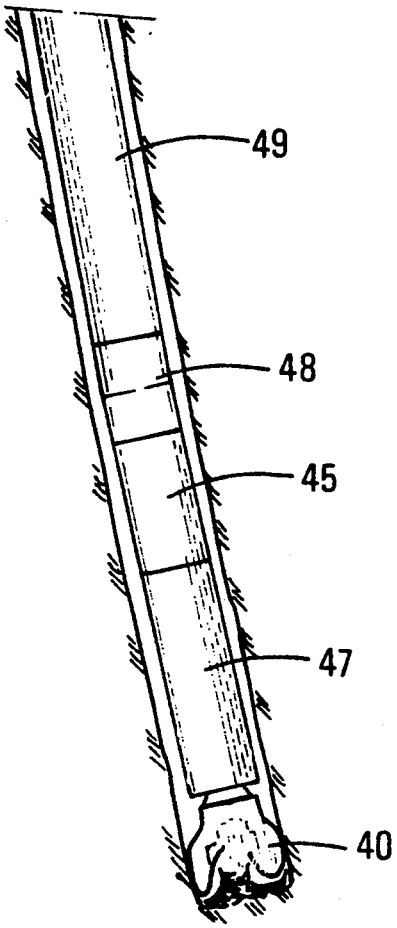
FIG. 9 gives an example of the application of the device to a drill string notably used to perform azimuth corrections.

FIG. 9 shows a directional drilling string notably used for the drilling stage known as build-up or for an azimuth correction. The drill bit 40 is rotated by downhole motor 47. Said device 45 is located above the motor. A bent sub with a variable angle 48, such as for example the one disclosed in French patent 2,432,079, can be controlled by means of the operating device. Conventional tubular elements 49 complete the drill string. When the angle of the bent sub is wished to be changed, the device will be operated as disclosed in the present invention and the appropriate coupling means will modify the angle of said bent sub.

We claim:

1. A device for remotely operating equipment in a well through variation in a flow of a fluid which comprises coupling means for coupling the device to the equipment to be operated, an assembly comprising at least two elements cooperating with one another to control an opening value of a channel through which said fluid flows and a control assembly for adjusting said opening value to have said value take on one or the other of two particular opening values, wherein the remote operation of the equipment is carried out for predetermined flow conditions when said control assembly is set to one of the two particular opening values of said elements and wherein for the same flow conditions, the remote operation is not obtained when said control assembly is set to the other opening value of said at least two elements.

2. A device as claimed in claim 1, wherein the assembly comprising at least two elements comprises a flow bean and a needle and wherein said coupling means supports one of these elements and wherein the other element is slidably mounted in a pipe connected to the coupling means.

3. A device as claimed in claim 2, wherein said control assembly comprises means for blocking the sliding of said element slidably mounted in said pipe, which means limits sliding of said element according to two stroke lengths which correspond to said predetermined opening values.

4. A device as claimed in claim 2, wherein the element slidably mounted in the pipe comprises a return means wherein said return means sets the opening value of the channel through which the fluid flows to a value smaller than said predetermined opening values, wherein a hydrodynamic force generated by the flow of the fluid at the level of said element slidably mounted in the pipe acts against the force developed by said return means and wherein said hydrodynamic force makes said element slidably mounted slide by one or another sliding stroke value corresponding to a predetermined opening value.

5. A device as claimed in claim 2, wherein said element supported by said coupling means is slidably mounted in relation to said coupling means and wherein said element comprises a return means whose force acts against a hydrodynamic force generated by the flow of the fluid at the level of said elements supported by said coupling means.

6. A device as claimed in claim 2, wherein said element supported by the coupling means is a flow bean, wherein the other element is a needle and wherein said coupling means comprises an operating shaft.

7. A device as claimed in claim 1, wherein said control assembly comprises a system of fingers cooperating with a groove of variable depth with a shape that adjusts a sliding stroke of said element slidably mounted in the pipe according to said two particular opening values.

8. A device as claimed in claim 2, wherein the needle comprises different straight-line sections over a length thereof, wherein cooperating with these straight-line sections with the flow bean causes a variation in the flow rate of the fluid and wherein the variation in the flow rate can be remotely measured.

9. A device as claimed in claim 1, wherein the control assembly is set to one of the two particular opening positions by a change in the flow rate of said fluid.

10. A device as claimed in any one of claims 1, 2, 3, 4, 5 or 6, wherein the device operates equipment integrated in a drill string.

11. A device as claimed in claim 9, wherein the device operates one or several variable geometry stabilizers or a variable angled bent sub to control the direction of the trajectory of a wellbore produced by said drill string.

* * * * *